United States Patent [19]

Anderson

[11] Patent Number: 5,000,448

[45] Date of Patent: Mar. 19, 1991

[54] BASEBALL BASE

[76] Inventor: Gene J. Anderson, Site 8, Compartment 28, R.R. #5, Vernon, B.C., Canada, V1T 6L8

[21] Appl. No.: 491,240

[22] Filed: Mar. 9, 1990

[51] Int. Cl.[5] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 801,279 | 10/1905 | Skye | 273/25 |
| 1,001,909 | 8/1911 | Vincent | 273/25 |
| 2,046,126 | 6/1936 | Latina | 273/25 |
| 2,084,775 | 6/1937 | Orefice | 273/25 |
| 2,103,148 | 12/1937 | Conrad | 273/25 |
| 2,122,266 | 6/1938 | Seys | 273/25 |
| 2,156,469 | 5/1939 | Boltz | 273/25 |
| 2,220,142 | 11/1940 | Broxton | 273/25 |
| 2,275,547 | 3/1942 | Mouch | 273/25 |
| 2,471,736 | 5/1949 | Fleming et al. | 273/25 |
| 2,494,511 | 1/1950 | Josselson | 273/25 |
| 2,624,580 | 1/1953 | Corbett | 273/25 |
| 2,695,784 | 11/1954 | Orsetti et al. | 273/25 |
| 2,756,999 | 7/1956 | Orsetti | 273/25 |
| 3,181,863 | 5/1965 | Nellermoe | 273/25 |
| 3,938,804 | 2/1976 | Willett | 273/25 |
| 4,266,768 | 5/1981 | Hall | 273/25 |
| 4,915,383 | 4/1990 | Yamakuchi et al. | 273/25 |

*Primary Examiner*—Theatrice Brown

*Attorney, Agent, or Firm*—Dellett, Smith-Hill and Bedell

[57] ABSTRACT

The present invention provides an improved safety base for use in the game of baseball. Prior breakaway safety bases required anchor members permenantly installed in the ground which were expensive, difficult to install and inappropriate for amateur teams required to carry their own bases from game to game. The present invention uses flexible strips of material attached directly to the ground by small spikes or nails and provided with one element of a hook-and-loop fastener, the other element being provided on the base.

11 Claims, 3 Drawing Sheets

FIG. 1
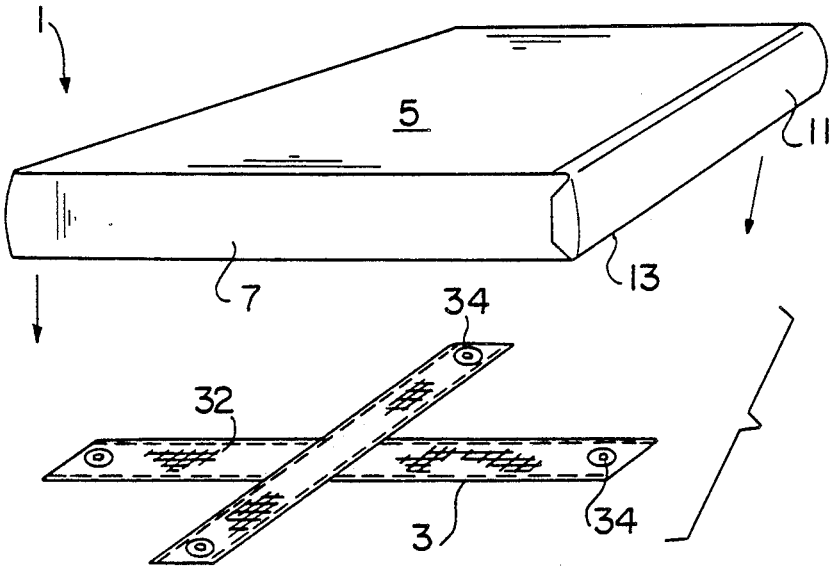
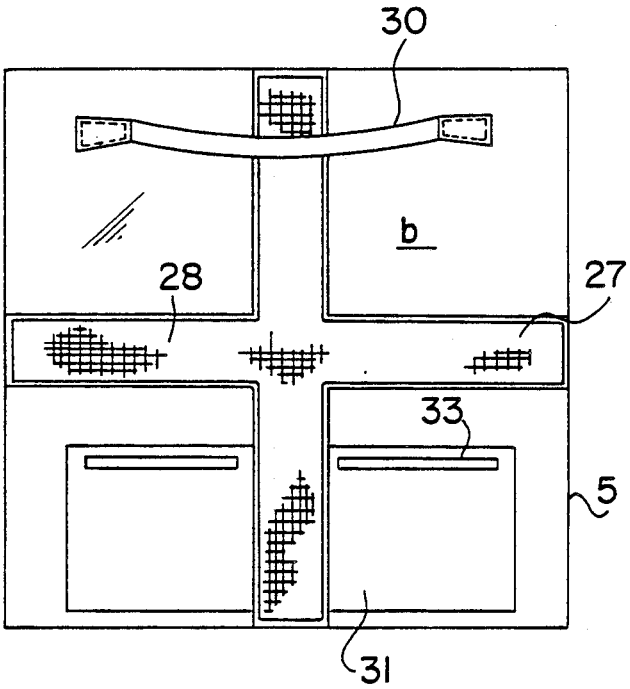
FIG. 2

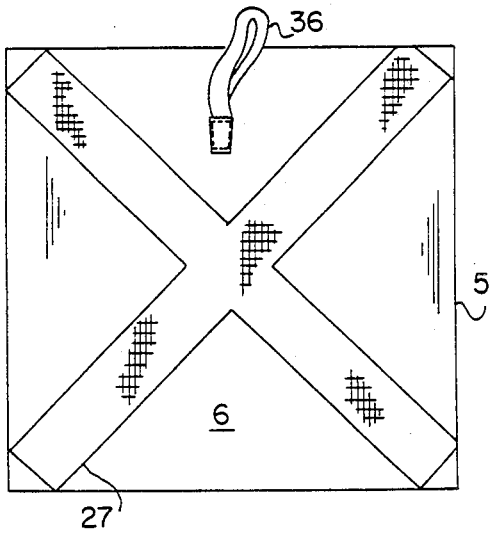
FIG. 5
FIG. 6
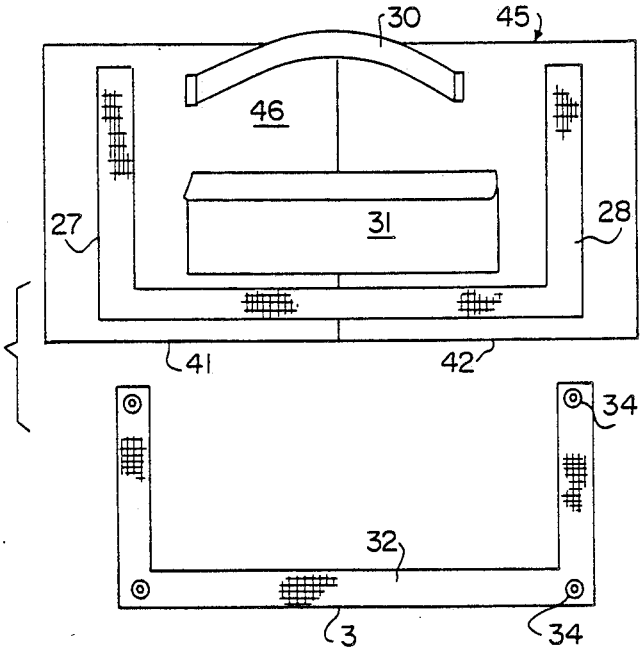
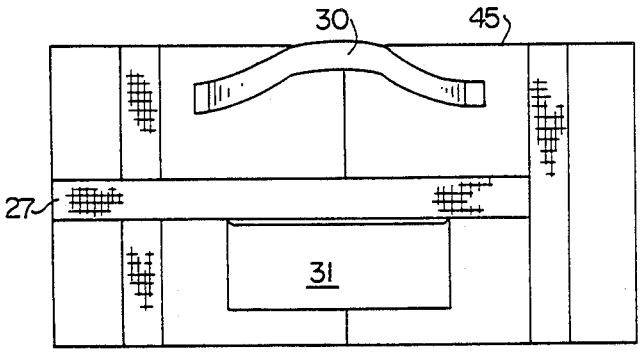
FIG. 7

BASEBALL BASE

BACKGROUND OF THE INVENTION

The invention relates to bases for use in the game of baseball and more particularly to safety bases.

The game of baseball involves the use of square canvas-covered bags or bases at three of the four corners of the baseball diamond. Players must safely reach these bases prior to the arrival of the ball or prior to the tagging of the player and so often a player will slide into the bag at considerable speed to avoid the tag. Previously, the bases have been rigidly secured to the ground using a spike. The problem with such method is that the runner sliding into the base at high speed may be injured due to the impact with the rigid base.

Consequently, various safety bases have been developed which break free from their attachment to the ground when sufficient lateral force is applied to the base. For example, Hall U.S. Pat. No. 4,266,768 discloses a breakaway safety base in which the base is secured to a ground support by resilient deformable interengageable members carried on both the base and support and which form a number of connections securing the base to the support. Sufficient lateral forces on the base shear the connections, freeing the base.

Fatool U.S. Pat. No. 4,529,199 discloses a safety base in which the lower element is secured to the ground by two spikes. The ground support element is T-shaped and fits within a recess in the bottom of the base. Selliken U.S. Pat. No. 3,862,756 discloses a magnetically attached baseball base. There is a sunken T-shaped member with an upper surface plate which is installed flush with the ground surface. Four magnets are provided on each corner of the plate and there is an x-shaped rib formed on the upper surface of the plate for locating the base.

Meggs U.S. Pat. No. 4,690,403 discloses a baseball base having a ferromagnetic metal plate on the underside of the base which is secured to an anchor member having magnetic bands.

A problem with these various designs is that they are relatively difficult to install, generally requiring permanent installation of the base anchor member, and are also relatively expensive to purchase. Consequently they are not practical for amateur baseball teams who carry their own bases to each game for installation on a new diamond for each game. There is therefore a need for a simple, inexpensive and easily installed breakaway safety base.

SUMMARY OF THE INVENTION

The present invention provides a safety baseball base comprising a resilient base member having a lower surface provided with an area comprising a first fastening element of a hook-and-loop fastener, and an anchor member. The anchor member comprises a flexible substrate having an area provided with a second fastening element of a hook-and-loop fastener complementary to the first element. The substrate comprises a plurality of apertures for receiving means to secure said substrate to a ground surface. The anchor member may be X-shaped, cross-shaped, H-shaped or C-shaped.

BRIEF DESCRIPTION OF THE DRAWINGS

In drawings which illustrate a preferred embodiment of the invention:

FIG. 1 is a perspective view of the bag and anchor element of a first embodiment of the invention;

FIG. 2 is a bottom view of the bag of the embodiment of the invention shown in FIG. 1;

FIG. 5 is a plan view showing the bottom of the base of a third embodiment of the invention;

FIG. 6 is a plan view showing the bottom of the base and top of the anchor element of a fourth embodiment of the invention; and FIG. 7 is a plan view showing the bottom of the base of a fifth embodiment of the invention.

DETAILED DESCRIPTION OF A PREFERRED EMBODIMENT

Figure 3:
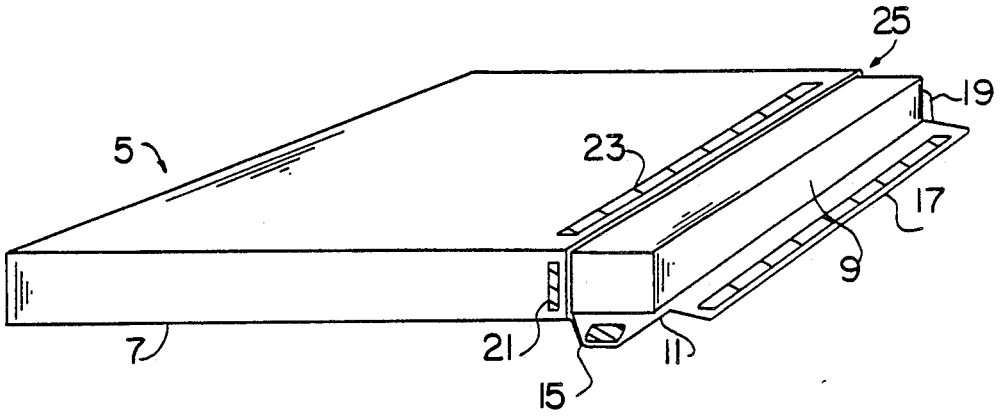
FIG. 3 is a perspective view of the bag of the embodiment of the invention shown in FIG. 1 with the side flap open and foam inserted partly removed.

With reference to FIGS. 1 through 3, the safety base of the invention, designated generally as 1, consists of anchor element 3 and bag element 5. Bag element 5 consists of a square canvas cover 7 and a foam rubber insert 9. Insert 9 can be inserted or removed by opening flap 11 which is fixed to bag 5 along edge 13 and removably attached along its three other edges by flaps 15, 17 and 19. Flaps 15, 17 and 19 are each provided with one element of a hood and loop fastener as sold under the trade-mark VELCRO, with the other element of the fastener being secured to bag 5 at locations 21, 23 and 25. This construction allows the bag to be more easily washed or repaired and also allows the insert to be saved after the canvas cover is worn out.

Figure 4:
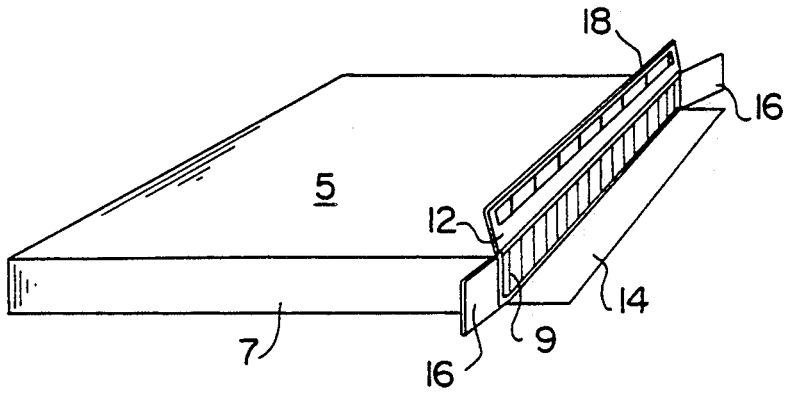
FIG. 4 is a perspective view (not to scale) of a second embodiment of the invention showing the side flap open to expose the foam insert.

A different flap arrangement is shown in the embodiment illustrated in FIG. 4. The flaps in this embodiment are similar to those used for standard cardboard boxes. Once foam insert 9 has been inserted into canvas cover 7, side flaps are first folded over the ends of the foam. Bottom flap 14 is then folded up over the end of the foam insert and side flaps 16. It has a strip of hood and loop fastener on its underside (not shown) which is exposed when it is folded up. The complementary fastener strip 18 is secured to the inner surface of top flap 12, which is folded over flap 14 and secured by the hook and loop fastener.

The bottom surface 6 of bag 5, as shown in FIG. 2, is provided with a cross-shaped element 27 fixed to surface 6 and having on its surface one of the elements 28 (whether the hook or loop element) of a VELCRO-type fastener. A handle 30 for carrying the bag is also provided as well as pouch 31, with closure elements 33, for storing the anchor element 3 and required nails.

Anchor element 3 consists of a cross-shaped piece of a flexible material such as vinyl, nylon or leather, provided on its surface with the complementary VELCRO element 32 to element 28 on bag 5. At the end of each arm of the cross is hole 34 which receives a nail (not shown) to secure anchor 3 to the ground.

To use the base, the anchor element 3 is placed at the appropriate location for the base with VELCRO side 32 facing upwardly. The four arms of anchor 3 are secured to the ground using four nails inserted through holes 34 and hammered into the ground. Bag 5 is then placed on anchor 3 so that the cross-shaped VELCRO elements 28 and 32 mate. The bag is thus secured in place, but will tear away from anchor 3 if sufficiently great lateral forces are applied.

A modified embodiment of the invention as applied to standard single bases is shown in FIG. 5. In this case the cross-shaped element 27 is secured to bottom surface 6 diagonally from corner to corner. A modified form of handle 36 is also shown.

Special double safety bases are sometimes used for first base, particularly in mixed baseball leagues, to avoid collisions between the runner and first baseman. The base is twice as large as a standard base, with the two halve having different colours. One half of the base is reserved for the runner, and the other half for the first-baseman. An embodiment of the invention suited for such double bases is shown in FIG. 6. Double base 45 has base halves 41 and 42. In this case, anchor element 3 is C-shaped with four holes 34 as shown. The corresponding element 27 fixed to the bottom surface 46 of bag 45 is similarly C-shaped. FIG. 7 illustrates a further embodiment in which the element 27, and corresponding anchor element 3, are H-shaped.

In very muddy conditions, the VELCRO fasteners may become clogged and fail to work. To allow for this eventuality, bag 5 may also be provided with slots on either end of the bag to receive a strap. One or two spikes could then be used in the traditional way to secure the bag directly to the ground.

As will be apparent to those skilled in the art, various modifications and adaptations of the structure above described may be made without departing from the spirit of the invention, the scope of which is to be construed in accordance with the accompanying claims.

I claim:

1. A safety baseball base for use in a regulation baseball or softball game, said base comprising:

(a) a resilient base member having a lower surface provided with an area comprising a first fastening element of a hook-and-loop fastener; and (b) a flexible anchor member having an area provided with a second fastening element of a hook-and-loop fastener complementary to said first element, said anchor member having a plurality of apertures for receiving means to secure said anchor member to a ground surface.

2. The safety base of claim 1 wherein said anchor member is generally X-shaped.

3. The safety base of claim 1 wherein said anchor member is generally cross-shaped.

4. The safety base of claim 1 wherein said anchor member is generally C-shaped.

5. The safety base of claim 1 wherein said anchor member is generally H-shaped.

6. The safety base of claim 1 wherein said resilient base member comprises a removable insert and a cover element having a releasable flap.

7. The safety base of claim 1 wherein said ground-securing means comprise nails.

8. The safety base of claim 1 wherein said flexible substrate comprises a thin, strong yet flexible material selected from the group of vinyl, nylon, or leather.

9. The safety base of claim 1 wherein said resilient base member comprises a removable pad of flexible material and a durable cover comprising flap means adapted to removably secure said resilient pad within said cover.

10. The safety base of claim 9 further comprising a pouch secured to said lower surface for storage of said anchor element.

11. The safety base of claim 9 further comprising handle means secured to said lower surface for carrying said base.

* * * * *